United States Patent [19]

von der Eltz et al.

[11] 3,990,840

[45] Nov. 9, 1976

[54] PROCESS AND DEVICE FOR THE DYEING AND/OR FINISHING OF TEXTILE PLANE ARTICLES

[75] Inventors: Hans-Ulrich von der Eltz, Frankfurt am Main; Walter Gulden, Hofheim, Taunus; Richard Bruno Wassner, Frankfurt am Main, all of Germany

[73] Assignee: Hoechst Aktiengesellschaft, Frankfurt am Main, Germany

[22] Filed: Oct. 8, 1975

[21] Appl. No.: 620,813

Related U.S. Application Data

[63] Continuation of Ser. No. 342,490, March 19, 1973, abandoned.

[30] Foreign Application Priority Data

Mar. 24, 1972 Germany ..... 2214377

[52] U.S. Cl. ..... 8/18 R; 8/14; 8/62; 8/149.1

[51] Int. Cl.[2] ..... D06P 5/00

[58] Field of Search ..... 8/149.1, 62, 18, 14

[56] References Cited

UNITED STATES PATENTS

| | | | |
|---|---|---|---|
| 1,948,568 | 2/1934 | Faber et al. | 68/5 C |
| 2,200,485 | 5/1940 | Broderson | 252/6 |
| 2,971,458 | 2/1961 | Kumins et al. | 8/62 |
| 3,762,860 | 10/1973 | Abrahams | 8/21 A |

FOREIGN PATENTS OR APPLICATIONS

| | | | |
|---|---|---|---|
| 1,540,770 | 10/1967 | France | 8/173 |

OTHER PUBLICATIONS

Lister, Abstract of Society of Dyers and Colourists, Jan. 1972, pp. 9–13, in World Textile Abstracts, May, 1972, p. 324.

*Primary Examiner*—John Kight, III
*Attorney, Agent, or Firm*—Curtis, Morris & Safford

[57] ABSTRACT

Process for the dyeing and/or finishing textile of plane articles made of synthetic or natural fibers or of mixtures of such fibers, by applying in a foamed form and at room temperature onto the goods with the acid of a gaseous propellant, a liquor containing at least one dyestuff and/or finishing agent suitable for the corresponding type of fiber, if required, chemical products necessary for their fixation as well as surface-active substances and subjecting the material thus treating for fixing the dyestuffs and/or finishing agents optionally after the decomposition or destruction of the foaming layer and if necessary by means of oxydating agents to the action of heat or subjecting it to a wet development operation by passing it through a bath consisting of an acid or an alkali, or dwelling it at room temperature or at a moderately raised temperature.

17 Claims, No Drawings

PROCESS AND DEVICE FOR THE DYEING AND/OR FINISHING OF TEXTILE PLANE ARTICLES

This is a continuation of application Ser. No. 342,490 filed Mar. 19, 1973, now abandoned.

The present invention relates to a process and to a device for the dyeing and/or finishing of textile plane articles.

When dyeing textile plane articles, expecially woven piece-goods, on the foulard, difficulties due to the material with regard to the even application of the dyebath frequently arise. Even though some construction types of such apparatus make possible extremely high roller pressures which may be varied as to the width and even though the regular pressing of the squeezing rolls is taken into account by special mechanical elements, the side-to-side tailing of shade cannot always be completely avoided. It is known that the pressure of the rollers makes possible only to a limited extent an adjustment to the quality of the material. For example, textile materials with pile surfaces, such as carpet piece goods, cannot be dyed continuously, in any case, on conventional foulards with squeezing rolls, on account of the pole deformation. Therefore, to avoid impregnation on the foulard, some constructors of textile machines — looking for other methods — have passed to continuous exhaustion methods according to which for example a polyamide or wool carpet material is continuously passed through a hot bath (multi-chambered roller vat) containing acid dyestuffs. With regard to the recent state of the art, however, it is still very difficult to obtain dyeings with completely even tails. Furthermore, the technique by exhaustion mentioned could not be used hitherto for woven and knitted fabrics, which is related to the capacity of liquor pick-up.

From the journal "Textilveredelung 6 (1971), No. 11, p. 708–711" a process is known according to which ready-made knitted textiles are dyed in a rotating drum with a finely vesicular, one-phase aqueous foam which is formed by special, anionic or non-ionic auxiliaries and simultaneously contains dyestuffs or chemical products for fixation. This method has been developed with the purpose to dye the dyeing good in an extremely short goods-to-liquor ratio; in so doing a small requirement of water and energy and a tolerable pollution of the waste water is aimed at. For this purpose the liquid portion in the total volume of the foam is kept as small as possible. After distributing the foam with the aid of centrifugal force in the dyeing drum (similar to that used in dry cleaning) at room temperature, the contents of the drum is heated to the dyestuff fixation temperature with steam or hot air, the material is treated for some time at this temperature, then cooled and centrifuged. Thus, this method of operation is a discontinuous process which, furthermore, is not suitable for piece-goods but only for finished products.

The present invention relates to a process for the dyeing and/or finishing of textile plane articles made of synthetic or natural fibre materials or of mixtures of such fibres, which comprises applying in a foamed form and at room temperature onto the goods with the aid of a gaseous propellant, a liquor containing at least one dyestuff and/or finishing agent suitable for the corresponding type of fibre, if required chemical products necessary for their fixation as well as surface-active substances, and subjecting the material thus treated for fixing the dyestuffs and/or finishing agents optionally after the decomposition or destruction of the foaming layer and if necessary by means of oxydating agents, to the action of heat, or subjecting it to a wet development operation by passing it through a bath consisting of an acid or an alkali, or dwelling it at room temperature or at a moderately raised temperature.

The process claimed has shown that a ready dyestuff solution — applied in foamed form onto the textile material — yields extremely even and regular dyeings. The dyebath may have the form of a real solution, a colloid system, a dispersion or of a suspension. According to the invention such dyestuff preparation is foamed with the aid of a gaseous propellant and applied onto the material as foam having an average vesicle size of 0.01 to 0.1 mm. It is no longer necessary to squeeze off the dyebath; thus, the height of the foam determines the amount of dyestuff applied. Furthermore, the foam may be additionally distributed evenly on the fabric surface with a suitable device, for example a straight or, if desired, sickel-shaped doctor knife, which may have a concave or convex cumber, or with a rotating roll fulfilling the same purpose. This makes it possible to adjust the dyestuff application to any fabric surface and any kind of fabric construction. The convex shape of one foulard roll is better replaced by the doctor knife distributing the foam.

According to the new process the composition of the dyeing preparation, i.e. the ratio of the propellant to the liquid portion containing dyestuffs and auxiliaries is important for the amount of foam to be applied. The distance between the scraping doctor knife or the distribution roller and the surface of the material is adjusted in the way that the amount of foam desired is applied in any case. From that derives the height of the foam and, thus, the amount of the liquor applied (liquid portion). It is advantageous to express or to calculate the amount of the foam by the weight increase (per surface unit) or per kg of material (surface is the function of the square meter weight), i.e. in analogous way as the squeezing off effect (liquor pick-up) in the case of paddings is expressed in % of the dry weight of the material. The weight of the propellant may always be neglected. The homogeneous distribution of the foam is obtained by regulating the propellant pressure and the nozzle and by mixing continuously the optionally two-phase liquid portion before the formation of the foam.

The foam obtained serves to apply and distribute the foamed liquor uniformly onto the material. Subsequently the foamed state of the bath is no more necessary and has to be altered. According to the invention this proceeds either by a spontaneous decompositon due to the special composition of a temporarily solid foam in connection with a transport speed regulated accordingly or by destruction of the foam due to the supply of a defoaming agent (for example spraying a solution of a defoamer or contact of the foam surface with a roller which is supplied with a solution). In the latter case the foam is destroyed directly behind the distribution device (roller or doctor knife), so that the transport speed of the material is less dependent on the composition of the foamed bath.

The preparation of foams which are used according to the present invention for the dyeing of textile material is always effected by mixing intimately the dyeing liquor with a gas, this one flowing into the liquid under pressure by a specially shaped nozzle. The dyeing liquor must contain in any case a surface-active substance. The nozzle permits the leaving of the gas with high speed and makes by its shape that the individual gas vesicles are regularly distributed. According to the invention the nozzle will be always adjusted in the way that the leaving of the gas is accompanied by an intimate mixing of the dyeing liquor. Thus, suspensions which have settled or emulsions being demixed are immediately mixed intimately. Even if the dyeing liquor consists of several single components not mixable with one another, these single components are very regularly distributed according to the method described, as it has not been possible hitherto.

For preparing foams according to the present process are used above all as propellants inert gases, preferably nitrogen, furthermore air, carbon dioxide and dinitrogen monoxide. Further suitable propellants are simple hydrocarbons, such as methane, ethane, propane, butane etc. Halogenated hydrocarbons, for example difluoro-dichloro-methane as such or in mixture with tetrafluoro-dichloro-ethane are also sufficiently known as propellants. Dimethyl ether or methyl chloride or ethyl chloride may also be used.

In accordance with the above-described surface-active substances make possible the formation of foam according to the process described. Such foam-producing products are for example polyalkylene-oxide compounds such as alkyl polyglycol ethers, nonyl-phenol polyglycolethers having 4 to 30 ethylene oxide units, fatty acid polyglycol esters, isotridecanol-polyglycol ethers and fatty acid alkylol amide polyglycol ethers, quarternary ammonium compounds of straight-chained and branched, saturated and unsaturated alkyl carboxylic acids and alkyldimethyl-aryl-ammonium chlorides as well as mixtures of such substances, furthermore alkyl sulfonates (mersolates), alkyl arylsulfonates, fatty alcohol sulfonates and anionic fatty acid condensation products. These foam-producing auxiliaries simultaneously have a marked wetting effect.

The solidity and the consistance of the foam can be regulated by suitable additives. The way of how the foam is decomposed, whether quickly or slowly, as well as the state, if the foam is finely porous or medium porous, or whether it contains solvents therein, everything can be adjusted to the corresponding dyeing process and the dyestuff used.

All known products which are usually taken into account for the dyeing of the corresponding fibre types are suitable as dyestuffs for the new process, for example anionic direct dystuffs, acid dyestuffs, 1 : 2 metal complex dyestuffs, 1 : 1 metal complex dyestuffs, mordant dyestuffs, reactive dyestuffs and cationic dyestuffs, furthermore pigment dyestuffs (also together with pigment binding agents), disperse dyestuffs, dispese dyestuffs soluble in solvents, dispersed metal complex dyestuffs, vat dyestuffs, leuco esters of vat dyestuffs, sulfur dyestuffs and polycondensation dyestuffs, furthermore the developing dyestuffs produced on the fibre from two component systems from the naphthol or metal phthalocyanine series. Instead of dyestuffs which absorb in the visible range, other dyestuffs which absorb in the ultraviolet range, i.e. optical brighteners are also suitable. Thus, the invention provides the use of dyestuffs or optical brighteners soluble in water, solvents and unsoluble (capable of being dispersed) according to the fibre material available. The fixation process or the solvent system independantly from its chemical constitution (as for example azo-or anthraquinone derivatives.) Apart form these dyestuffs synthetic resins of each type or antistatic agents may be applied by spraying onto the textiles used.

While carrying out the process of the invention the foam is applied from nozzles being shaped as a point or as a slot die. Such nozzles can also be attached at an excenter, whereby the nozzles — for imitating determined dyeing techniques — are controlled by programs, the foam being applied onto the fabric for example in a rotating or elliptical movement. However, such measure always includes the full width of the material.

The foams applied by spraying may also contain organic solvents or said mixtures or consist completely of said solvents. In most cases azeotropic water-containing mixtures are concerned.

It is furthermore possible to achieve on the basis of the foam spraying technique according to the present invention multi-color effects without any further expenditure. Polychromatic processes, flowing effects and multi-color processes can be easily realized with the aid of color foams. By using particularly formed doctor knives which can be handled in a longitudinal and transverse sense to the direction of the material the height of the foam layer can be varied to achieve shade dyeings and, thus, further possibilities of design. By chemical products contained in the different foams, such as alkalis or acids, printing effects can be imitated. According to the present process a "differential dyeing technique" or "space dyeing technique" can be carried out without different fibre qualities available. Foams having different physical properties are simply sprayed simultaneously close together or according to a special design. The differential-dyeing-technique is realized by varying the height of the foam. Effect dyeings can also be achieved by the different size of the foam visicles in the foams applied, i.e. by adding determined surface-action substances. A large field for possibilities of design is opened by using simultaneously foams flowing into one another, or by combining a flowing or dissociating foam with one or several sold foams applied simultaneously or subsequently. A kind of printing effect is obtained with adjacent solid foams.

The dyeing process claimed proceeds as follows: The material is passed through a spraying device or in the simplest case a trough filled with foam, with a speed taking into account the decomposition of the foam. Subsequently, the foam is brought to an equal level by a doctor knife or a roller. A squeezing device or a similar device is not necessary. After a few seconds the foam is either decomposed on account of its composition or it is destroyed by spraying with foam-reducing or foam-destroying solvents. It is also possible for this purpose to touch the foam-layer with a roller impregnated with a defoamer. In accordance with the type of dyestuffs applied and for fixing them on the corresponding type of fibres the material thus treated is then either wound up and dwelled in the moist state or it is introduced into a steamer, hot flue or into a thermosol plant, where it is subjected to the action of heat. A wet fixation or a short-time exhaustion process with and without solvents is also possible for the development of the dyestuffs. An intermediate drying is expediently effected only if large amounts of foam have been applied.

According to the process described, the possibilities of migration are excluded, since the liquid portion contained in the foam can be kept at a lower degree than hitherto possible. Therefore, the dyestuff has no possibility of migrating with the liquid phase.

The new dyeing process may also be carried out in a vacuum device; the material is first evacuated and then passed through a further chamber filled with foam so that the material absorbs in this case a very finely porous foam. It is also possible to apply the foam on a sieve drum or a sieve belt plant: An equally finely porous foam, i.e. a foam having visicles as fine as possible is absorbed through the fabric. For vacuum and suction application solid foams are preferably used. After an application process of this type however, the foam will always have to be destroyed.

With regard to the technical process achieved according to the present invention, it has to be pointed out that the process of foaming always corresponds according to its principle to a padding impregnation without foulard or to an immersion without trough. Furthermore, the application of the foam has the advantage that the dyestuff application is more uniform.

The device used in the process claimed for applying dyestuffs and/or finishing agents simultaneously with the chemical products necessary for their fixation, essentially consists of at least one propellant tank, one or several pressure vessels, wherein are stored the dissolved or dispersed dyestuffs and/or finishing agents, wash-active substances, water and/or solvents, emulsifiers and chemical products to adjust suitable pH-conditions for dyeing, as well as at least one nozzle to spray the filling of the pressure vessel; the afore-mentioned attachments of the device are connected with one another in the order indicated, if desired, via a pipe line. The vessel itself consists of a material resistant to pressure and may be provided with a special internal layer in order to be protected against aggressive or corroding products. The pressure vessels used according to the invention have a capacity of 1 to 500 kg, preferably 10 to 100 kg.

It is known from lacquer spray containers that they contain little balls to mix the contents, which makes it easier to disperse again a pigment which has settled. However, as soon as the filling of such vessels and thus, the vessels required reach a determined size, such balls can no longer be used as mixing auxiliaries. Therefore, the pressure vessel according to the invention contains a double sieve plate, a flat blade or a magnetic agitating means shaped accordingly for mixing the dyeing preparation thoroughly. The mixing proceeds mechanically or directly by the propellant flowing into the vessel. Such vessels, in which above all systems consisting of different phases can be transported, may additionally contain a vortex chamber. In this chamber the various liquids and solutions or dispersions are thoroughly mixed or emulsified before being foamed, passing in this state to the foam nozzle. Thus, a very homogeneous and even distribution of the pressure vessel, filling is insured. The mixing and foaming of dyestuffs, preparations, compositions and auxiliaries is effected with the aid of tanks which contain the propellant.

The special advantage of separate and interchangeable dyestuff vessels is that a completely ready dyestuff composition is available which yields - when being applied - a determined color build-up. For dyeing small material lots, single ready-deliverable dyestuff preparations are particularly interesting. In the case of large lots, stationary devices or the container principle will be mainly used.

A concrete example for a pressure vessel according to the device of the present invention is given in the annexed scheme in cross section. The reference numbers used have the following meaning:

1. channel from the propellant tank
2. wall of the pressure vessel
3. connection with the spraying nozzle
4. sieve plate mixer
5. dyeing liquor with a surface-active substance
6. mixture of difluoro-dichloromethane and tetrafluorodichloroethane (gaseous)
7. mixture of difluoro-dichloromethane and tetrafluorodichloroethane (liquified)

The Color Index Numbers mentioned in the Examples are taken from the second edition 1956 and from the supplementary volume 1963.

The following Examples illustrate the invention.

EXAMPLE 1:

2 Grams of the cationic dyestuff of the formula

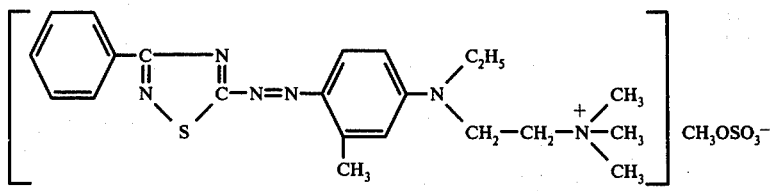

were dissolved in 50 g of hot water with addition of 0.5 g of a 60% acetic acid. After cooling 24 g of isopropanol and 5 g of the reaction product of 1 mol of nonylphenol and 10 mols of ethylene oxide were added and this solution was filled up to a liquor volume of 100 g by adding water of room temperature.

90 Percent of this solution was mixed in a spraying vessel resistant to pressure with 10 % of difluorodichloromethane. Then the solution was sprayed through a slot die as a finely vesicular foam with a liquid portion of 2 % and applied in a 3 cm layer onto a fabric of 100 5 polyacrylic fibres, moving in warp direction in the horizontal sense, which corresponds to a liquor pick-up of 200 % per kg of material. Then the foam layer was limited to the adjusted height by a doctor knife or roller attached directly behind the foaming nozzle and uniformly spread over the full width of the material. In the case of the above-mentioned composition of the liquor and the propellant mixture the foam had spontaneously decomposed after 10 seconds and the liquor (liquid portion of the foam) had uniformly penetrated the material. Subsequently, the textile material thus treated was continuously steamed for 10 minutes with saturated steam of 105° C without intermediate drying, then rinsed and after a washing process dried and worked up.

A completely uniform, intense red dyeing was obtained over the full width of the material and the fastness properties thereof correspond to those of a comparable dyeing obtained according to a padding process.

Equally good dyeing results were obtained when up to 20 % of tetrafluoro-dichloroethane were added to the above-mentioned propellant difluoro-dichloromethane.

When replacing in the above Example 5 g of the reaction product of 1 mol of nonyl phenol and 10 mols of ethylene oxide as foaming substance by a mixture of 2 g of dodecyl-dimethyl-benzyl-ammonium chloride and 3 g of octadecyl-dimethyl-benzyl-ammonium chloride, equally good results with regard to color yield and fastness properties were obtained.

EXAMPLE 2

To prepare the dyeing on a plane fabric of 100 % polyacrylic fibres the operation was carried out as indicated in Example 1, but a combination of 1.5 g of the cationic dyestuff of the formula

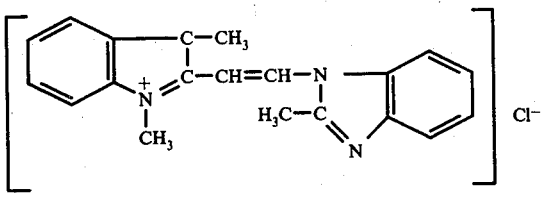

and 0.5 g of the cationic dyestuff of the formula

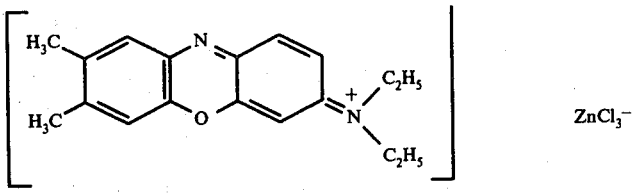

was used.

4.5 Grams of the reaction product of 1 mol of coconut fat amine and 8 mols of ethylene oxide were used as wash-active substance in this dyeing. The height of the foam (liquor pick-up) was adjusted to the color intensity desired. An even green dyeing was obtained.

EXAMPLE 3

1 Gram of the acid dyestuff Acid Blue 40 — C.J. No. 62 125 was dissolved in 70 g of hot water with addition of 0.5 g of a 60 % acetic acid; after cooling this solution 18 g of isopropanol and 5 g of the reaction product of 1 mol of nonyl phenol and 10 mols of ethylene oxide were added and the batch was filled up to a liquor volume of 100 g by adding water of room temperature.

90 Percent of this solution was mixed in a spraying vessel fast to pressure with 10 % of difluoro-dichloromethane and applied as a finely vesicular foam with a liquid portion of 2 % onto a web of tufted carpet material of polyamide fibres with a backing material of polypropylene strips, in a 5 cm layer through foaming slot dies. The total weight of the material was 400 g/m$^2$, the polyamide portion 160 % of the weight of the material consisted of 50 % of light-dyeing and 50 % of deep-dyeing differential yarns. A foam having this composition and the 5 cm amount applied had a liquid portion of 1 l/m$^2$, which corresponds to a liquor pick-up of 250 %, calculated on the total weight of the material. While being foamed, the material was passed on the horizontal level in the longitudinal sense, the foam was knife-coated to a 5 cm height and thus evenly spread over the whole material web. After passing a short distance the material entered the steamer. The material thus treated was steamed for 20 minutes at 105° C with saturated steam without intermediate drying; then the dyeing was rinsed, washed continuously, squeezed off and dried.

On the dyed carpet a well-differentiated blue tone-in-tone effect was obtained. The surface with different color intensities showed — when considered separately — completely uniform dyeings and are free from frosting effect.

Similar dyeing effects were obtained when a textile material consisting completely of medium-dyeing fibres was covered with the above-mentioned dyeing foam and this one was partly removed from determined spots with the aid of a doctor knife of grated form.

EXAMPLE 4

4 Grams of a disperse dyestuff consisting of a mixture of different diaminodihydroxyanthraquinones brominated with less than 1 mol of bromine per molecule of dyestuff, were dispersed in 50 g of hot water with addition of 0.5 g of a 60 % acetic acid. After cooling 20 g of isopropanol and 5 g of a polymerization product of propylene oxide and ethylene oxide having a content of 40 % by weight of polymerized ethylene and this solution was filled up to a liquor volume of 100 g by adding water of room temperature.

90 Percent of this solution was mixed in a spraying vessel fast to pressure with 10 % of difluoro-dichloromethane. Then the solution was sprayed through a slot die as a finely vesicular foam with a liquid portion of 2 % and applied in a 1 cm layer onto a fabric of 100 % polyester fibres (texturized network) moving in warp direction in the horizontal sense, which corresponds to a liquor pick-up of about 200 % per kg of material. Then the foam layer was limited to the adjusted height by a doctor knife or a roller attached directly behind the foaming nozzle and uniformly spread over the full width of the material. In the case of the above-mentioned composition of the liquor and the propellant mixture the foam had decomposed after 30 seconds and the liquor (liquid portion of the foam) had uniformly penetrated the material. Subsequently, the textile material this treated was intermediately dried with infrared radiation without being touched and continuously thermosolated for 5 minutes at 165° C, then rinsed and after a reductive cleaning at 85° C with an aqueous bath of 3 cc/l of sodium hydroxide solution 38° Be, 2 g/l of hydrosulfite and 0.5 g/l of the reaction product of 1 mol of nonyl phenol and 9 mols of ethylene oxide and a washing process the material was dried and worked up.

The full width of the material showed a completely even intense blue dyeing, the properties of which correspond to those of a dyeing obtained according to a padding process. The fabric showed an excellent penetration of the dye.

Equally good tinctorial results were obtained when up to 20 % of tetrafluoro-dichloroethane were added to the above-mentioned propellant difluoro-dichloromethane.

The following summary lists a series of possibilities for dyeing textile plane articles. The dyestuffs were dissolved in water or dispersed — as described in the preceding Examples, mixed with the chemical products and auxiliaries indicated in the table and then fixed according to the processes of development mentioned. The amounts by weight of the dyestuff etc. refer to a liquor volume of 100 g. In all Examples the development of the dyestuff or the condensation of the finishing agents was followed by a rinsing and washing process:

EXAMPLE 5

| | |
|---|---|
| Substratum: | polyester/cotton (67:33) |
| Dyestuffs: | 6 g of Disperse Yellow 5 - C.I. No. 12790<br>4 g of Reactive Yellow 17 - C.I. No. 18852 |
| Additives: | 0.5 g of acetic acid (60 %)<br>3 g of the reaction product of 1 mol of stearyl alcohol and 25 mols of ethylene oxide |
| Development: | Thermosoling for 1 min. at 210° C; then cross-padding with an aqueous liquor of 200 g/l of NaCl and 30 cc/l of NaOH 38° Bé. |

EXAMPLE 6

| | |
|---|---|
| Substratum: | polyester/viscose fibres |
| Dyestuffs: | 4 g of the disperse dyestuff of the formula<br> 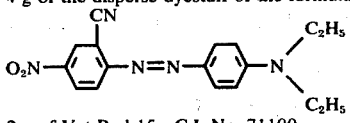 <br>2 g of Vat Red 15 - C.I. No. 71100 |
| Additives: | 0.5 g of acetic acid (60 %)<br>4 g of the addition compound of 8 mols of ethylene oxide and 1 mol of isotridecyl alcohol |
| Development: | thermosoling for 1 min at 200° C; then padding with an aqueous bath of 35 cc/l of NaOH, 38° C, and 30 g/l of hydrosulfite;<br>then steaming for 30 sec. at 103° C. |

EXAMPLE 7

| | |
|---|---|
| Substratum: | polyester/polynosic cellulose |
| Dyestuffs: | 8 g of the disperse dyestuff of the formula<br> 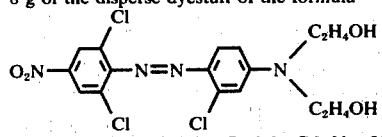 <br>5 g of Solubilised Sulphur Red 6 - C.I. No. 53720 |
| Additives: | 0.5 g of acetic acid (60 %<br>5 g of sodium octadecyl sulfonate |
| Development: | thermosoling for 1 min. at 210° C; then padding with an aqueous bath of 8 g/l of $Na_2CO_3$ and 10 g/l of NaSH; then steaming for 45 seconds at 105° C. |

EXAMPLE 8

| | |
|---|---|
| Substratum: | Polyamide |
| Dyestuff: | 3 g of Acid Orange 19 - C.I. No. 14690 |
| Additives: | 0.6 g of acetic acid (60 %)<br>2 g of the condensation product of formaldehyde and β-naphthalene-sulfonic acid.<br>3 g of an addition product of 1 mol of dodecyl phenol and 20 mols of ethylene oxide |
| Development: | steaming for 6 min. at 102° C. |

EXAMPLE 9

| | |
|---|---|
| Substratum: | cotton |
| Dyestuff: | 1 g of Solubilised Vat Orange 1 - C.I. No. 59106 |
| Additives: | 2 g/l of sodium nitrite<br>1 g of 2,5-dibutylnaphthalene-sulfonic acid sodium |
| Development: | passage with an aqueous bath of 20 cc/l of $H_2SO_4$(95 %). |

EXAMPLE 10

| | |
|---|---|
| Substratum: | cotton |
| Dyestuff: | 3 g of Reactive Blue 19 - C.I. No. 61200 |
| Additives: | 3.8 g of sodium salt of the N-methylamino-ethyl-sulfonic acid |
| Development: | Padding with an aqueous bath of 20 cc/l NaOH 38° Be and 250 g/l of NaCl; then steaming for 20 seconds at 101° C. |

EXAMPLE 11

| | |
|---|---|
| Substratum: | polyester/viscose |
| Finish: | 30 g of dimethylol urea |
| Additive: | 3.5 g of triethanolamine dodecylsulfate |
| Development: | Spraying of an aqueous bath of 10 g/l of $MgCl_2$; Drying at 100° C; condensing at 150° C during 5 min. |

EXAMPLE 12

| | |
|---|---|
| Substratum: | polypropylene |
| Dyestuff: | 4 g of Pigment Yellow 1 - C.I. No. 11680 |
| Additives: | aqueous self-reactive, copolymeric dispersion on acryl basis<br>6 g of the reaction product of 1,4-butanediol-monostearic acid ester and 7 mols of ethylene oxide |
| Development: | Drying at 100° C.<br>Condensing at 145° C during 5 min. |

EXAMPLE 13

| | |
|---|---|
| Substratum: | polypropylene |
| Dyestuff: | 4 g of Pigment Yellow 1 - C.I. No. 11680 |
| Additives: | aqueous plastics dispersion of polyvinyl chloride and/or polyvinyl-acetate<br>6 g of a reaction product of 1,4-butanediol-monostearic acid ester and 7 mols of ethylene oxide |
| Development: | Drying at 100° C;<br>Condensing at 145° C for 5 min. |

We claim:

1. In a process for the dyeing and/or textile finishing of flat articles made of synthetic or natural fiber materials or mixtures of such fibers, with at least one dyestuff and/or textile finishing agent suitable for the type of fiber in said article, and for the fixation of the dyestuff and of the finishing agent, the improvement of which comprises: applying, continuously, a liquor containing the said dyestuff and/or finishing agent to the goods, at room temperature, in the form of a foam having a gaseous propellant, so as to produce on the surface of the fibers, a layer of the foamed treating agent, the height of which foamed layer is controlled according to the desired liquor pick-up.

2. A process as claimed in claim 1 wherein multicolor effects according to the type of shadow dyeings are obtained by a different doctoring.

3. A process as claimed in claim 1, wherein multicolor effects are obtained by applying mixable and unmixable foams and/or by applying color foams of different durability or consistence in form of designs.

4. A process as claimed in claim 1, wherein the foam nozzles are regulated according to a program for imitating determined dyeing techniques.

5. A process as claimed in claim 1, wherein after application of the foam to the material the height of the foam is adjusted by means of a doctor knife or a roll.

6. A process as claimed in claim 5, wherein the height of the foam is adjusted to different levels over different parts of the material.

7. A process as claimed in claim 5, wherein, after adjusting the height of the foam, the foam is destroyed.

8. A process as claimed in claim 7, wherein the foam is self-decomposing after a period of time.

9. A process as claimed in claim 7, wherein the foam is destroyed by the application of a defoamer.

10. A process as claimed in claim 1, wherein the average vesicle size of the foam is from 0.01 to 0.1 mm.

11. A process as claimed in claim 1, wherein the liquid portion of the foam consists of an organic solvent or a mixture of organic solvents or of an azeotropic mixture of one or more organic solvents and water.

12. A process as claimed in claim 1, wherein two or more foams which are miscible with one another are applied.

13. A process as claimed in claim 12, wherein two or more foams which are miscible with one another are applied.

14. A process as claimed in claim 12, wherein two or more foams which are not miscible with one another are applied.

15. A process as claimed in claim 12, wherein two or more foams of different stability are applied.

16. A process as claimed in claim 12, wherein two or more foams of different consistency are applied.

17. A process as claimed in claim 1, wherein the application of the foam is regulated by a predetermined program.

* * * * *